US007140076B2

(12) United States Patent
Hsu

(10) Patent No.: US 7,140,076 B2
(45) Date of Patent: Nov. 28, 2006

(54) REINFORCING MEMBER FOR A KNOB FOR A LOCK

(75) Inventor: Su-Mei Hsu, Kaohsiung Hsien (TW)

(73) Assignee: Taiwan Fu-Hsing Industrial Co., Ltd. (TW)

( * ) Notice: Subject to any disclaimer, the term of this patent is extended or adjusted under 35 U.S.C. 154(b) by 0 days.

(21) Appl. No.: 10/329,432

(22) Filed: Dec. 27, 2002

(65) Prior Publication Data

US 2004/0123428 A1 Jul. 1, 2004

(51) Int. Cl.
*E05B 3/00* (2006.01)

(52) U.S. Cl. ..... 16/414; 292/336.3

(58) Field of Classification Search ..... 16/110.1, 16/406, 412, 414, 417, 431, 433, 441, DIG. 24, 16/DIG. 30; 292/336.3, 347, 348, 356, 357, 292/DIG. 30, DIG. 53; 220/241; D8/300
See application file for complete search history.

(56) References Cited

U.S. PATENT DOCUMENTS

| | | | | | |
|---|---|---|---|---|---|
| 2,179,604 | A | * | 11/1939 | Tinnerman | 248/239 |
| 2,529,219 | A | * | 11/1950 | Kost | 403/361 |
| 2,537,750 | A | * | 1/1951 | Gretschel | 190/116 |
| 2,615,745 | A | * | 10/1952 | Young | 292/348 |
| 2,676,049 | A | * | 4/1954 | Wurzel | 292/347 |
| 2,745,689 | A | * | 5/1956 | Balint et al. | 403/357 |
| 2,854,277 | A | * | 9/1958 | Erkkila | 292/348 |
| 3,012,808 | A | * | 12/1961 | Zion | 292/347 |
| 3,602,539 | A | * | 8/1971 | James | 292/353 |
| 3,779,590 | A | * | 12/1973 | Sanders et al. | 292/336.3 |
| 3,826,527 | A | * | 7/1974 | Ramsey | 292/359 |
| 3,856,339 | A | * | 12/1974 | Tornoe et al. | 292/336.3 |
| 4,052,768 | A | * | 10/1977 | Yamazaki et al. | 16/441 |
| 4,502,719 | A | * | 3/1985 | Perry | 292/347 |
| 4,746,155 | A | * | 5/1988 | Hart | 292/351 |
| 5,190,327 | A | * | 3/1993 | Lin | 292/348 |
| 5,316,355 | A | * | 5/1994 | Hartwell et al. | 292/347 |
| 5,749,612 | A | * | 5/1998 | Meck et al. | 292/347 |
| 5,752,399 | A | * | 5/1998 | Shen | 70/224 |
| 5,782,119 | A | * | 7/1998 | Ellis et al. | 70/371 |
| 5,787,744 | A | * | 8/1998 | Berger et al. | 70/422 |
| 5,960,517 | A | * | 10/1999 | Sprekeler | 292/336.3 |
| 6,532,629 | B1 | * | 3/2003 | Armstrong | 16/414 |
| 6,533,336 | B1 | * | 3/2003 | Kemp et al. | 292/348 |

FOREIGN PATENT DOCUMENTS

DE 3910967 A1 * 10/1990

* cited by examiner

*Primary Examiner*—Robert J. Sandy
*Assistant Examiner*—Andre' L. Jackson
(74) *Attorney, Agent, or Firm*—Bacon & Thomas PLLC

(57) ABSTRACT

A knob for a lock includes a knob body and a reinforcing member. The knob body has a side, and a neck extends outward from the side of the knob body and has a slot. The reinforcing member is mounted around the neck and has a stop that is engaged in the slot of the neck. An escutcheon is mounted around the reinforcing member. The knob has increased strength for withstanding larger force intended to destroy the lock through either jimmying the connection area between the side of the knob body and an end wall of the escutcheon or hammering an outer face of the knob body.

16 Claims, 6 Drawing Sheets

REINFORCING MEMBER FOR A KNOB FOR A LOCK

BACKGROUND OF THE INVENTION

1. Field of the Invention

The present invention relates to a reinforcing member for a knob of a lock to improve the strength of the knob for preventing destruction of the knob by an unauthorized user.

2. Description of the Related Art

FIG. 1 of the drawings illustrates a conventional knob and FIG. 2 illustrates a lock having the conventional knob in FIG. 1. The knob includes a knob body 90 and a neck 91 extending from a side of the knob body 90. An escutcheon 92 is mounted around the neck 91. When mounted to a door, an unauthorized user may use a sharp-pointed member 93 to jimmy the connection area between the knob body 90 and the escutcheon 92. Alternatively, the unauthorized user may directly hammer an outer surface of the knob body 90, which, in turn, presses against the escutcheon 92 and thus causes deformation of the escutcheon 92. As a result, the lock core can be removed.

SUMMARY OF THE INVENTION

An object of the present invention is to provide a reinforcing member for a knob of a lock to improve the strength of the knob for preventing destruction of the knob by an unauthorized user.

A knob for a lock in accordance with the present invention includes a knob body and a reinforcing member. The knob body has a side, and a neck extends outward from the side of the knob body and has a slot. The reinforcing member is mounted around the neck and has a stop that is engaged in the slot of the neck.

In an embodiment of the invention, the reinforcing member includes a cylindrical portion mounted around the neck. The cylindrical portion has a first end and a second end. The reinforcing member further includes a conic wall projecting from the first end of the cylindrical portion and extending to a position beyond the second end of the cylindrical portion. An abutting end wall projects from a distal end of the conic wall and extends on a plane orthogonal to a longitudinal direction of the cylindrical portion, with the abutting end wall abutting against the side of the knob body. An escutcheon is mounted around the conic wall of the reinforcing member.

In another embodiment of the invention, the reinforcing member is integrally formed by casting and includes a cylindrical portion, an abutting end wall, and a stop. The reinforcing member is covered by an escutcheon, with the cylindrical portion mounted around the neck, with the abutting end wall abutting against the side of the knob body, and with the stop being engaged in the lock core engaging slot of the neck and abutting against the end face of the slot of the spindle. The reinforcing member may further include a recessed portion for abutting against the end face of the protruded portion of the lock core.

The knob in accordance with the present invention has increased strength for withstanding larger force intended to destroy the lock through either jimmying the connection area between the side of the knob body and the end wall of the escutcheon or hammering an outer face of the knob body.

Other objects, specific advantages, and novel features of the invention will become more apparent from the following detailed description and preferable embodiments when taken in conjunction with the accompanying drawings.

DETAILED DESCRIPTION OF THE PREFERRED EMBODIMENTS

Preferred embodiments in accordance with the present invention will now be described with reference to the accompanying drawings.

Figure 1:
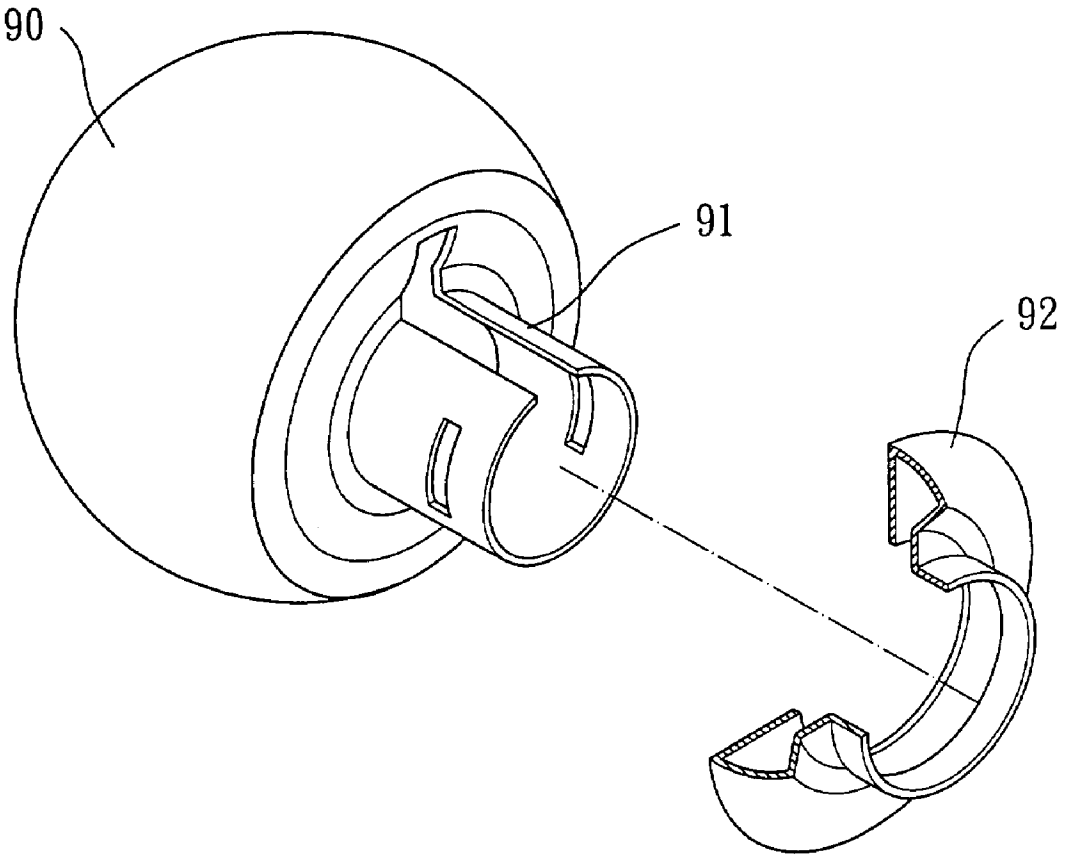
FIG. 1 PRIOR ART
FIG. 1 is an exploded perspective view of a conventional knob.
Figure 2:
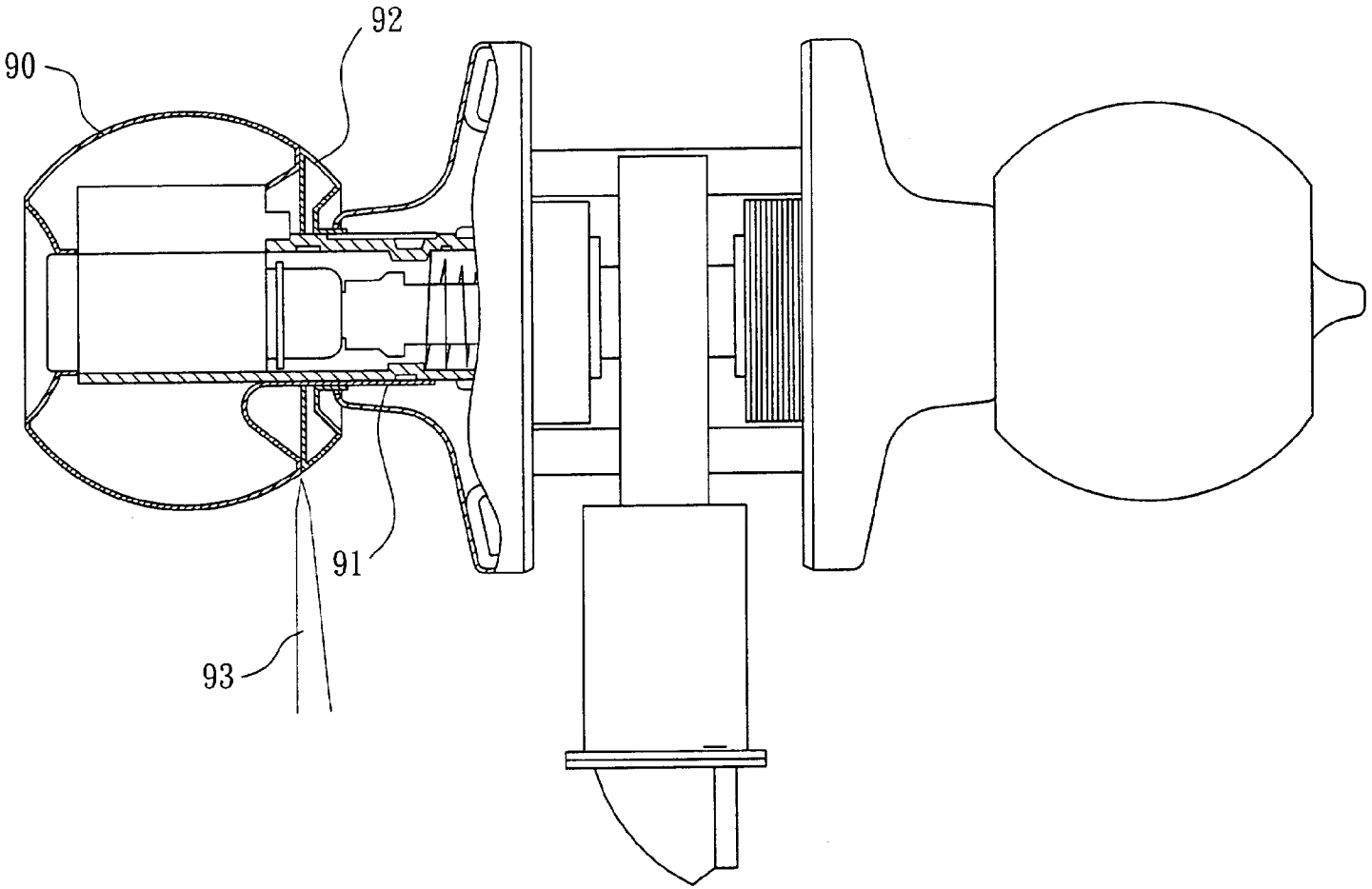
FIG. 2 PRIOR ART
FIG. 2 is a sectional view of a lock with the conventional knob of FIG. 1.
Figure 3:
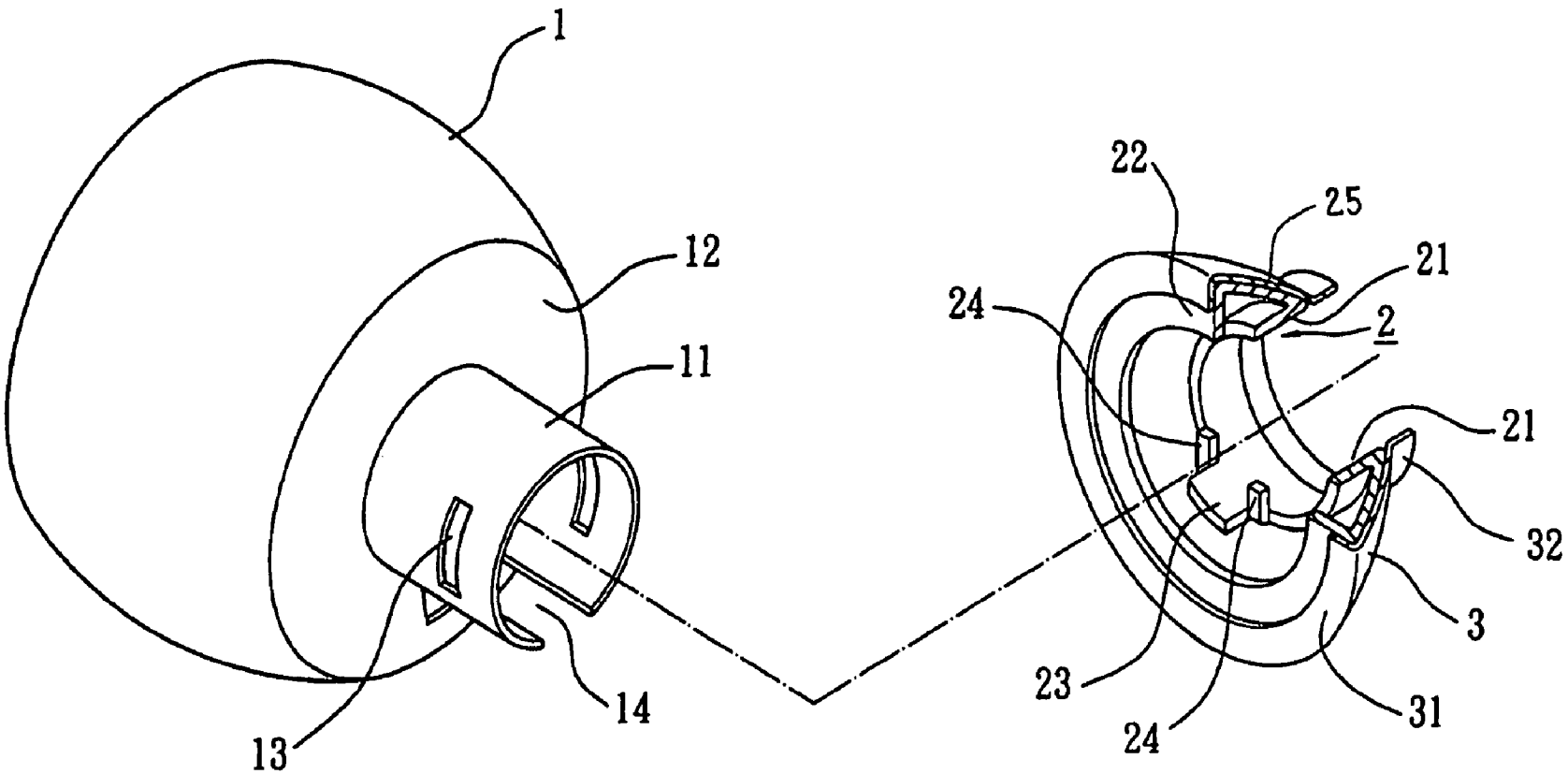
FIG. 3 is an exploded perspective view of a first embodiment of a knob in accordance with the present invention.
Figure 4:
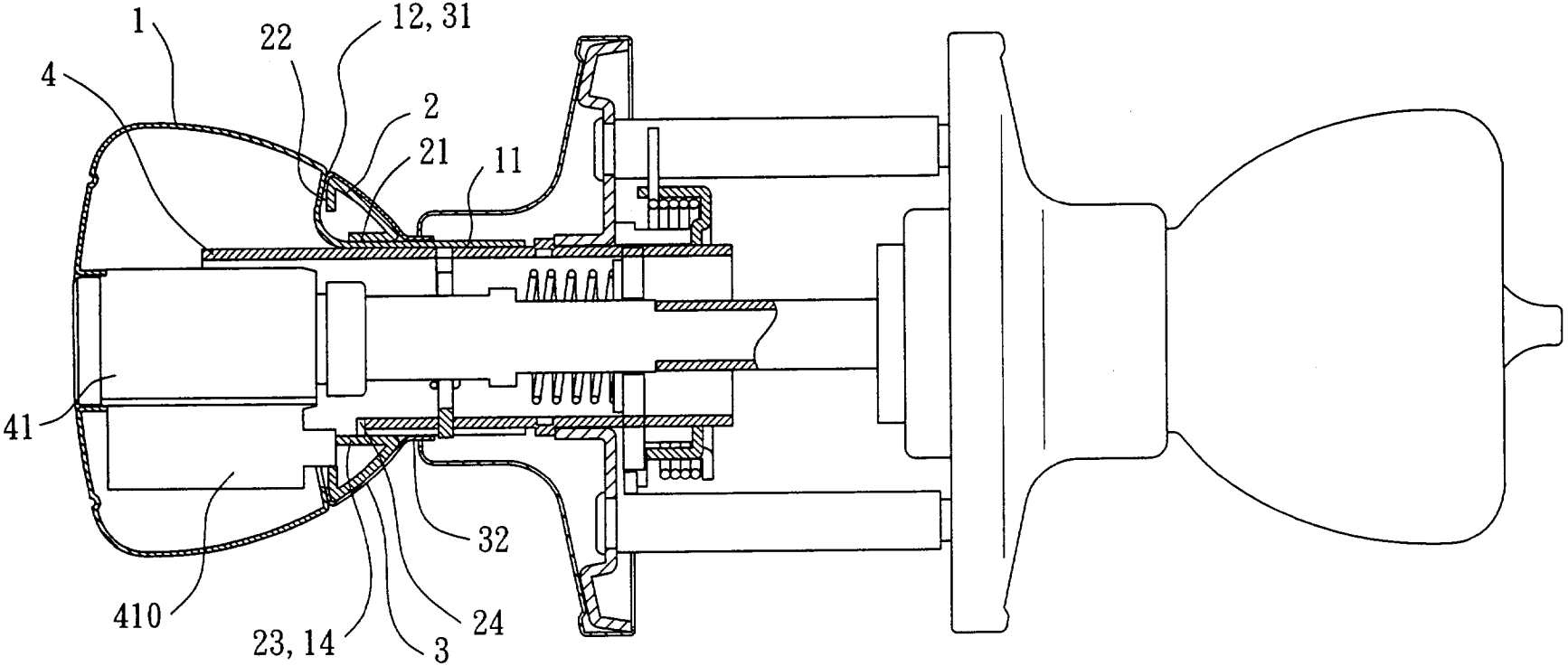
FIG. 4 is a sectional view of a lock with the knob in FIG. 3.

Referring to FIGS. 3 and 4, a first embodiment of a knob in accordance with the present invention generally includes a knob body 1, a reinforcing member 2, and an escutcheon 3.

The knob body 1 can be of any conventional shape and includes a neck 11 extending from a side 12 thereof for receiving a lock core 41 (FIG. 4). The reinforcing member 2 is mounted around the neck 11. The neck 11 includes an engaging slot 13 and a lock core engaging slot 14 for receiving a protruded portion 410 of a lock core 41 (FIG. 4), which are conventional.

The reinforcing member 2 is formed by means of punching a metal sheet having a certain thickness. The reinforcing member 2 includes a cylindrical portion 21 so as to be mounted around the neck 11. Further, the reinforcing member 2 has an abutting end wall 22 for abutting against the side 12 of the knob body 1. In this embodiment, a conic wall 25 projects from a first end of the cylindrical portion 21 and extends rearward to a position beyond a second end of the cylindrical portion 21, with an abutting end wall 22 extending from a distal end of the conic wall 25. Preferably, the abutting end wall 22 lies on a plane orthogonal to a longitudinal direction of the cylindrical portion 21. An engaging piece 23 projects from the second end of the cylindrical portion 21 and extends away from the first end of the cylindrical portion 21. Further, two stops 24 projects from the second end of the cylindrical portion 21 and extends radially inward. Preferably, the stops 24 are respectively provided on two sides of the engaging piece 23. The stops 24 are engaged in the lock core engaging slot 14 and abut against an end face (not labeled) of a slot 42 of a spindle 4 that is mounted to the neck 11 to turn therewith. The engaging piece 23 abuts against an end face (not labeled) of the protruded portion 410 of the lock core 41.

The escutcheon 3 is mounted around the reinforcing member 2 to provide an esthetically pleasing appearance. The escutcheon 3 is in intimate contact with an outer face of the conic wall 25 of the reinforcing member 2. An end wall 31 projects from an end of the escutcheon 3 and extends on a plane orthogonal to a longitudinal axis of the escutcheon 3. The end wall 31 abuts against the abutting end wall 22 of the reinforcing member 2. Further, an annular extension 32 projects from the other end of the escutcheon 3 and extends in a direction substantially parallel to the longitudinal axis of the escutcheon 3. The annular extension 32 extends beyond the first end of the cylindrical portion 21.

As illustrated in FIG. 4, the neck 11 is mounted around the spindle 4, the cylindrical portion 21 of the reinforcing member 2 is mounted around the neck 11, and the escutcheon 3 is mounted around the reinforcing member 2. The end wall 31 of the escutcheon 3 abuts against the side 12 of the knob body 1 (or the abutting end wall 22 of the reinforcing member 2 abuts against the side 12 of the knob body 1, if the escutcheon 3 is omitted). The stops 24 are engaged in the lock core engaging slot 14 of the neck 11 and abut against the end face of the slot 42 of the spindle 4.

In this embodiment, since the end wall 31 of the escutcheon 3 abuts against the side 12 of the knob body 1, since the stops 24 are engaged in the lock core engaging slot 14 of the neck 11 and abut against the end face of the slot 42 of the spindle 4, and since the engaging piece 23 of the reinforcing member 2 abuts against the protruded portion 410 of the lock core 41, the increased thickness provided by the reinforcing member 2 may withstand stronger force applied by an unauthorized user for jimmying the lock through the connection area between the end wall 31 of the escutcheon 3 and the side 12 of the knob body 1. Thus, the jimmying is vain. Further, if the unauthorized user hammers the knob body 1, since the stops 24 of the reinforcing member 2 are engaged in the lock core engaging slot 14 of the neck 11, since the stops 24 abut against the end face of the slot 42 of the spindle 4, and since the engaging piece 23 of the reinforcing member 2 abuts against the protruded portion 410 of the lock core 41, the external hammering impact could be transmitted through the lock core 41 or the knob body 1 to the reinforcing member 2 that abuts against the spindle 4. Thus, it is difficult to destroy the lock having a knob in accordance with the present invention.

Figure 5:
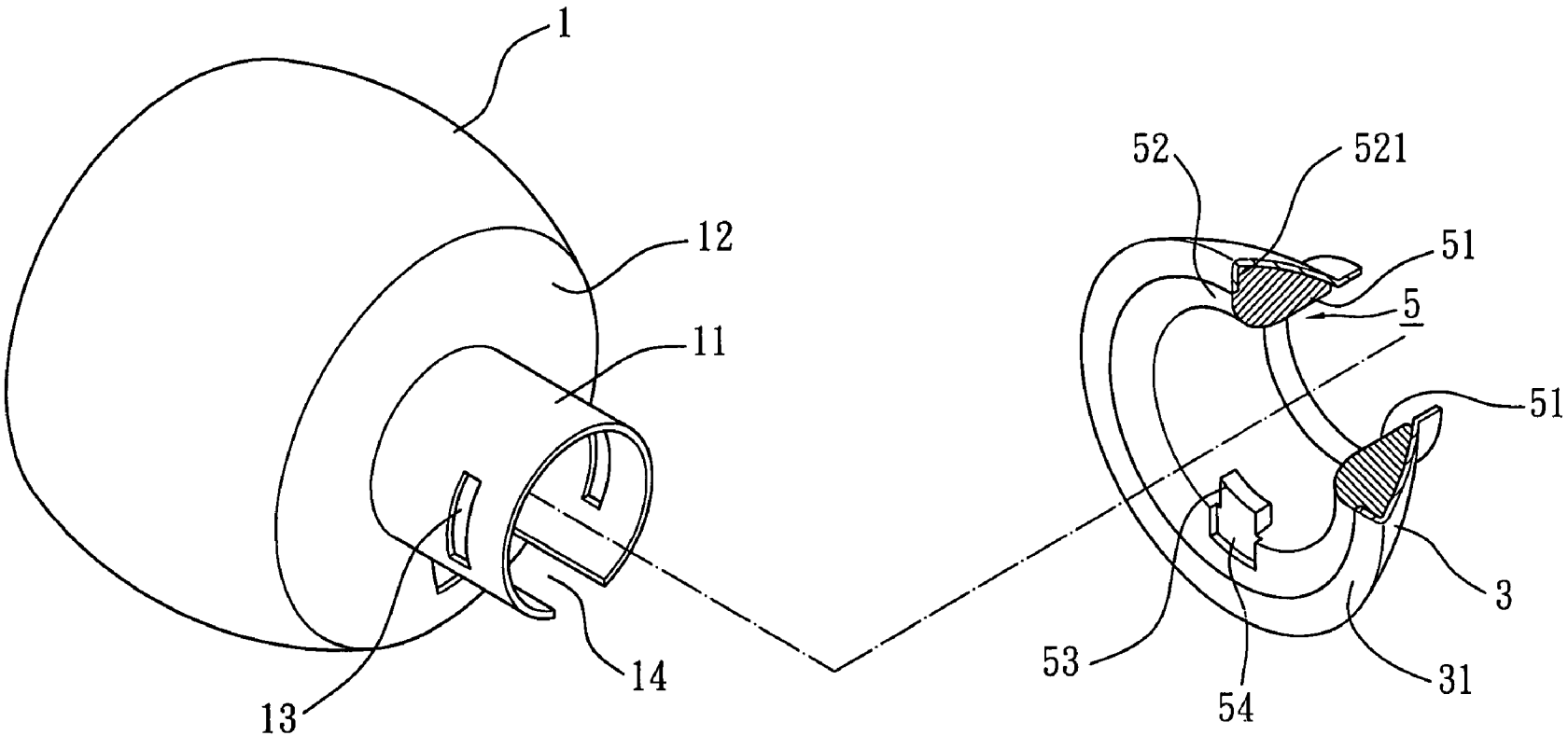
FIG. 5 is an exploded perspective view of a second embodiment of the knob in accordance with the present invention.
Figure 6:
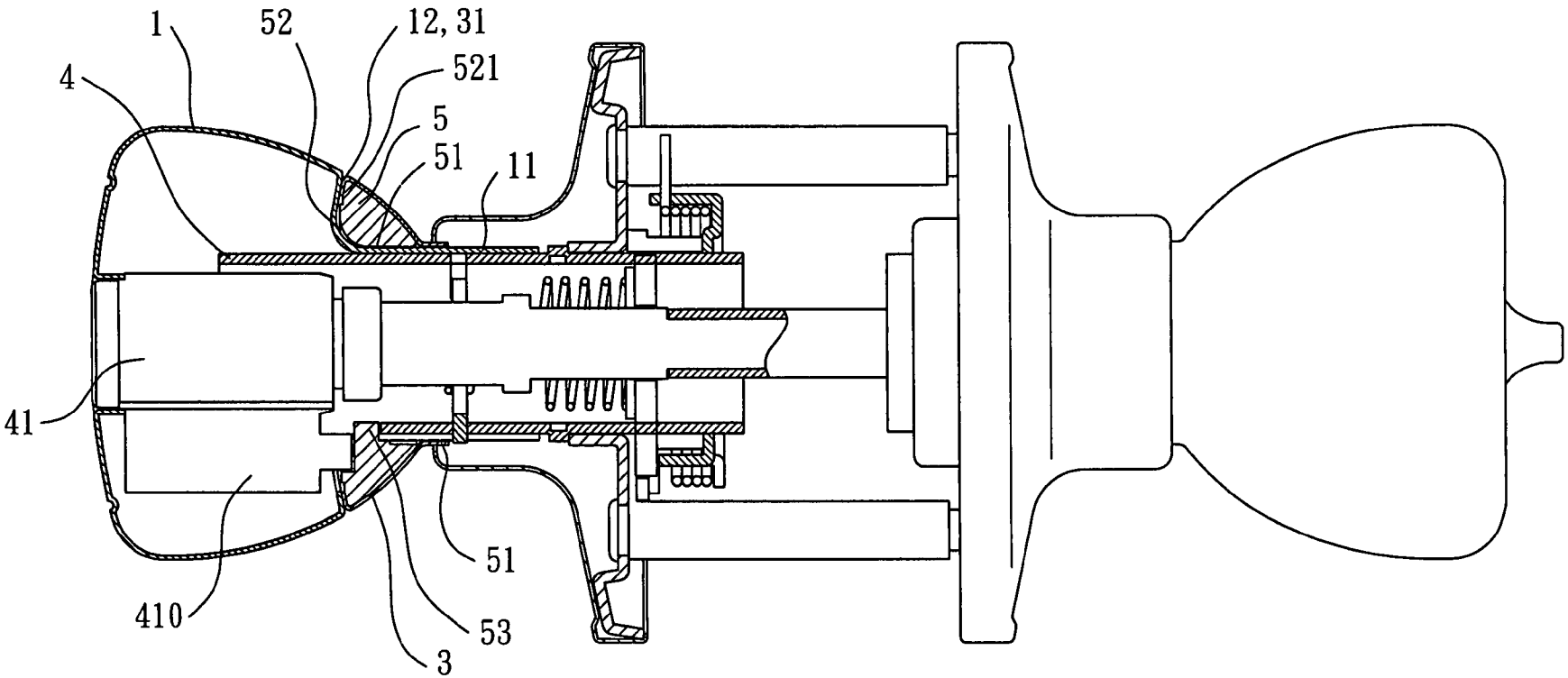
FIG. 6 is a sectional view of a lock with the knob in FIG. 5.

FIG. 5 shows a second embodiment of the knob in accordance with the present invention, and FIG. 6 shows a lock with the knob in FIG. 5. In this embodiment, the reinforcing member (now designated by 5) is integrally formed by casting and includes a cylindrical portion 51, an abutting end wall 52, and a stop 53. The reinforcing member 5 is covered by the escutcheon 3, with the cylindrical portion 51 mounted around the neck 11, with the abutting end wall 52 abutting against the side 12 of the knob body 1, and with the stop 53 being engaged in the lock core engaging slot 14 of the neck 1 and abutting against the end face of the slot 42 of the spindle 4. The reinforcing member 5 may further include a recessed portion 54 for abutting against the end face of the protruded portion 410 of the lock core 41. Thus, the reinforcing member 5 may retain the lock core 41 in place while withstanding external impact transmitted through the lock core 41.

The end wall 52 of the cylindrical portion 5 includes a stepped portion 521 formed thereon so as to receive the end wall 31 of the escutcheon (i.e. rear knob shell) 3.

In this embodiment, the reinforcing member 5 has increased strength and thus may withstand larger force intended to destroy the lock, as the reinforcing member 5 is integrally formed as a single unit.

The knob in accordance with the present invention has increased strength for withstanding larger force intended to destroy the lock through either jimmying the connection area between the side 12 of the knob body 1 and the end wall 31 of the escutcheon 3 or hammering the outer face of the knob body 1.

Although the invention has been explained in relation to its preferred embodiment as mentioned above, it is to be understood that many other possible modifications and variations can be made without departing from the scope of the invention. It is, therefore, contemplated that the appended claims will cover such modifications and variations that fall within the true scope of the invention.

What is claimed is:

1. A knob for a lock comprising:

a main knob body having a rear end side, a neck extending outward from the rear end side of the knob body and having a slot;

a rear knob shell having a first end attached to the rear end side of the knob body to constitute a knob unit, and a second end connected with a rose; and a reinforcing member mounted on the neck and received in an inner space of the rear knob shell for reinforcing and strengthening the entire structure of the rear knob shell, so that tampering through a gap between the main knob body and the rear knob shell is prevented, and the reinforcing member having a stop that is engaged in the slot of the neck, and the reinforcing member further including a cylindrical portion having a first end wall, wherein the cylindrical portion of the reinforcing member is mounted on the neck of the main knob body, the cylindrical portion having a first end and a second end, the reinforcing member further including a wall projecting from the first end of the cylindrical portion and extending to a position beyond the second end of the cylindrical portion, the first end wall projecting from a distal end of the wall and extending on a plane substantially orthogonal to a longitudinal direction of the cylindrical portion, with the first end wall of the reinforcing member substantially facing the rear end side of the main knob body;

wherein the rear knob shell further includes a second end wall that projects from an end of the rear knob shell adjacent to the first end wall of the reinforcing member, with the second end wall of the rear knob shell abutting against the first end wall of the reinforcing member, and with the second end wall of the rear knob shell abutting against the rear end side of the main knob body.

2. The knob as claimed in claim 1, wherein the rear knob shell includes an extension projecting from another end of the rear knob shell and extending beyond the first end of the cylindrical portion of the reinforcing member.

3. The knob as claimed in claim 1, wherein the wall of the reinforcing member is a conic wall projecting from the first end of the cylindrical portion and extending to a position beyond the second end of the cylindrical portion of the reinforcing member.

4. The knob as claimed in claim 1, wherein the first end wall of the reinforcing member is in contact with the rear end side of the main knob body.

5. The knob as claimed in claim 1, wherein the first end wall of the reinforcing member and the rear side of the main knob body are spaced apart.

6. The knob as claimed in claim 1, wherein the second end wall of the rear knob shell is sandwiched in-between the first end wall of the reinforcing member and the rear end side of the main knob body.

7. The knob as claimed in claim 1, wherein the cylindrical portion includes a stepped portion to receive the second end wall of the rear knob shell.

8. The knob as claimed in claim 7, wherein the stepped portion is formed on the first end wall of the cylindrical portion.

9. A knob for a lock comprising:

a main knob body having a rear end side, a neck extending outward from the rear end side of the main knob body;

a rear knob shell having a first end attached to the rear end side of the main knob body to constitute a knob unit, and a second end connected with a rose; and a reinforcing member mounted on the neck and received in an inner space of the rear knob shell for reinforcing and strengthening the entire structure of the rear knob shell, so that tampering through a gap between the knob body and the rear knob shell is prevented and the reinforcing member further including a cylindrical portion having a first end wall;

wherein the cylindrical portion of the reinforcing member is mounted on the neck of the main knob body, the cylindrical portion having a first end and a second end, the reinforcing member further including a wall projecting from the first end of the cylindrical portion and extending to a position beyond the second end of the cylindrical portion, the first end wall projecting from a distal end of the wall substantially facing the rear end side of the main knob body; and wherein the rear knob shell further includes a second end wall that projects from an end of the rear knob shell adjacent to the first end wall of the reinforcing member, with the second end wall of the rear knob shell abutting against the first end wall of the reinforcing member, and with the second end wall of the rear knob shell abutting against the rear end side of the main knob body.

10. The knob as claimed in claim 9, wherein the rear knob shell includes an extension projecting from another end of the rear knob shell and extending beyond the first end of the cylindrical portion of the reinforcing member.

11. The knob as claimed in claim 9, wherein the wall of the reinforcing member is a conic wall projecting from the first end of the cylindrical portion and extending to a position beyond the second end of the cylindrical portion of the reinforcing member.

12. The knob as claimed in claim 9, wherein the first end wall of the reinforcing member is in contact with the rear end side of the main knob body.

13. The knob as claimed in claim 9, wherein the first end wall of the reinforcing member and the rear end side of the main knob body are spaced apart.

14. The knob as claimed in claim 9, wherein the second end wall of the rear knob shell is sandwiched in-between the first end wall of the reinforcing member and the rear end side of the main knob body.

15. The knob as claimed in claim 9, wherein the cylindrical portion includes a stepped portion to receive the second end wall of the rear knob shell.

16. The knob as claimed in claim 15, wherein the stepped portion is formed on the first end wall of the cylindrical portion.

* * * * *